US006231015B1

(12) United States Patent
Kun

(10) Patent No.: US 6,231,015 B1
(45) Date of Patent: May 15, 2001

(54) COMBINED TEAPOY AND FOOTREST

(76) Inventor: Wu Ching Kun, PO Box 82-144, Taipei (TW)

( * ) Notice: Subject to any disclaimer, the term of this patent is extended or adjusted under 35 U.S.C. 154(b) by 0 days.

(21) Appl. No.: 09/537,493

(22) Filed: Mar. 30, 2000

(51) Int. Cl.[7] ..... F16M 11/20; F16M 11/38; F16M 11/32; A47C 4/08; A47D 1/02

(52) U.S. Cl. ..... 248/164; 248/171; 248/439; 297/18; 108/118

(58) Field of Search ..... 248/164, 155.5, 248/439, 171, 173, 456; 5/112; 108/118, 119, 120; 297/16.1, 18, 19, 24, 25

(56) References Cited

U.S. PATENT DOCUMENTS

| | | | | |
|---|---|---|---|---|
| 222,629 | * | 12/1879 | Howe | 248/439 |
| 2,127,398 | * | 8/1938 | Freeman | 248/439 |
| 3,692,358 | * | 9/1972 | Sung | 108/120 |
| 4,592,287 | * | 6/1986 | Thygeson | 108/118 |
| 4,861,100 | * | 8/1989 | Baccaro | 297/19 |
| 5,044,690 | * | 9/1991 | Torrey | 297/16.1 |
| 5,199,930 | * | 4/1993 | Weber | 248/439 |
| 5,483,901 | * | 1/1996 | Tisbo et al. | 108/119 |
| 5,496,094 | * | 3/1996 | Schwartzkopf et al. | 297/16.1 |
| 5,584,254 | * | 12/1996 | Williams | 108/118 |
| 5,647,285 | * | 7/1997 | Steward | 108/119 |
| 5,683,135 | * | 11/1997 | Williams | 108/118 |
| 5,813,721 | * | 9/1998 | Arcidiacono | 297/16.1 |

* cited by examiner

*Primary Examiner*—Ramon O. Ramirez
*Assistant Examiner*—J. DeLuca
(74) *Attorney, Agent, or Firm*—A & J

(57) ABSTRACT

A combined teapoy and footrest includes a rectangular table top having a bottom provided with four seats, an outer leg frame including two first legs and a cross bar mounted between the two first legs, each of the first legs having a through hole close to an upper end thereof pivotally connected with a respective one of the seats, an inner side of each of the first legs having an intermediate portion formed with a J-shaped groove having an indentation, and a notch between the through hole and the J-shaped groove, and an inner leg fame including two second legs and a cross bar mounted between the two second legs, each of the second legs having a through hole close to an upper end thereof pivotally connected with a respective one of the seats, an inner side of each of the second legs having an intermediate portion provided with a protuberance configured to be engageable with the J-shaped groove and the notch.

1 Claim, 3 Drawing Sheets

COMBINED TEAPOY AND FOOTREST

BACKGROUND OF THE INVENTION

1. Field of the Invention

This invention is related to a combined teapoy and footrest and in particular to one which can be easily converted from a teapoy to a footrest as desired and vice versa.

2. Description of the Prior Art

The conventional teapoy is simply a small legged stand for holding a tea service, while the conventional footrest is only a support for resting the feet on, thereby causing much inconvenience in use and wasting natural resources.

Therefore, it is an object of the present invention to provide a combined teapoy and footrest which can obviate and mitigate the above-mentioned drawbacks.

SUMMARY OF THE INVENTION

This invention is related to a combined teapoy and footrest.

According to a preferred embodiment of the present invention, a combined teapoy and footrest includes a rectangular table top having a bottom provided with four seats, an outer leg frame including two first legs and a cross bar mounted between the two first legs, each of the first legs having a through hole close to an upper end thereof pivotally connected with a respective one of the seats, an inner side of each of the first legs having an intermediate portion formed with a J-shaped groove having an indentation, and a notch between the through hole and the J-shaped groove, and an inner leg frame including two second legs and a cross bar mounted between the two second legs, each of the second legs having a through hole close to an upper end thereof pivotally connected with a respective one of the seats, an inner side of each of the second legs having an intermediate portion provided with a protuberance configured to be engageable with the J-shaped groove and the notch.

It is the primary object of the present invention to provide a combined teapoy and footrest which can be easily converted from a teapoy to a footrest as desired and vice versa.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
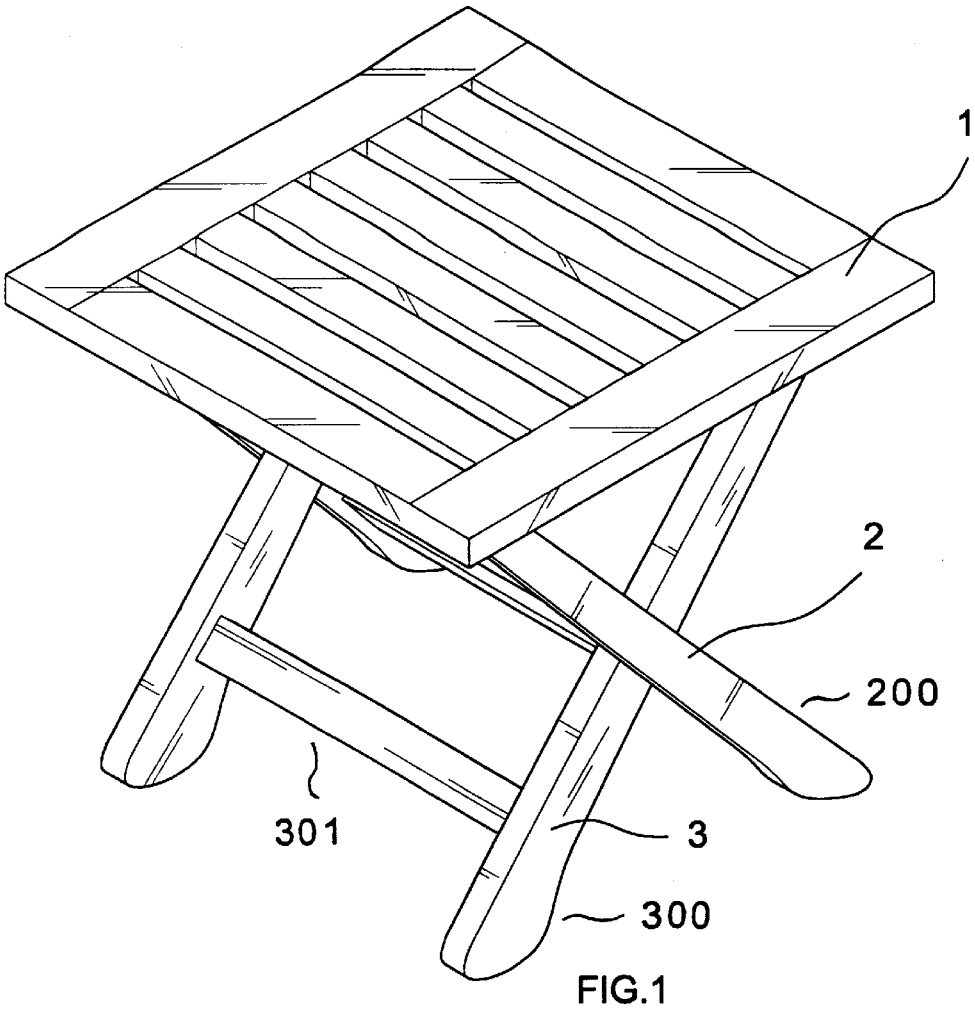
FIG. 1 is a perspective view of the present invention when used as a teapoy.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
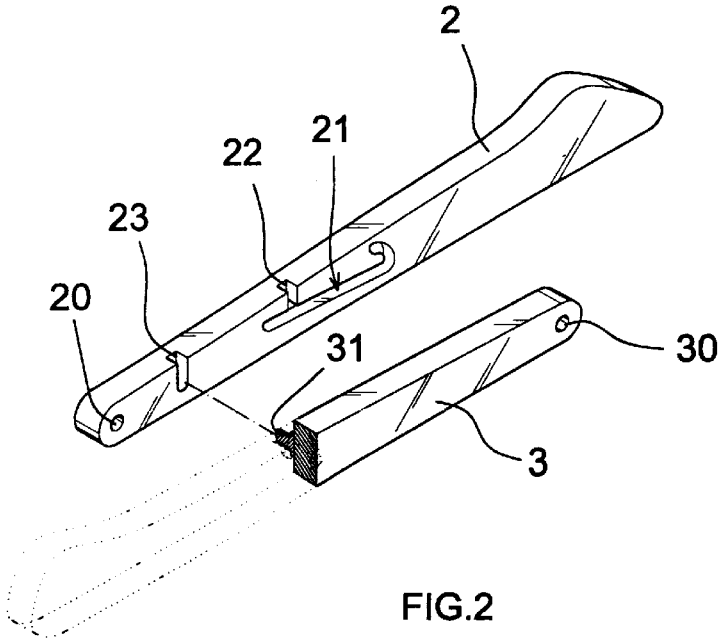
FIG. 2 illustrates how the outer leg is engaged with the inner leg.

With reference to the drawings and in particular to FIGS. 1 and 2 thereof, the combined teapoy and footrest according to the present invention generally comprises a table top 1, an outer leg frame 200 and an inner leg frame 300, wherein the table top 1 is rectangular in shape and the outer and inner leg frames 200 and 300 are arranged at a cross configuration to support the table top 1 thereon.

Figure 4:
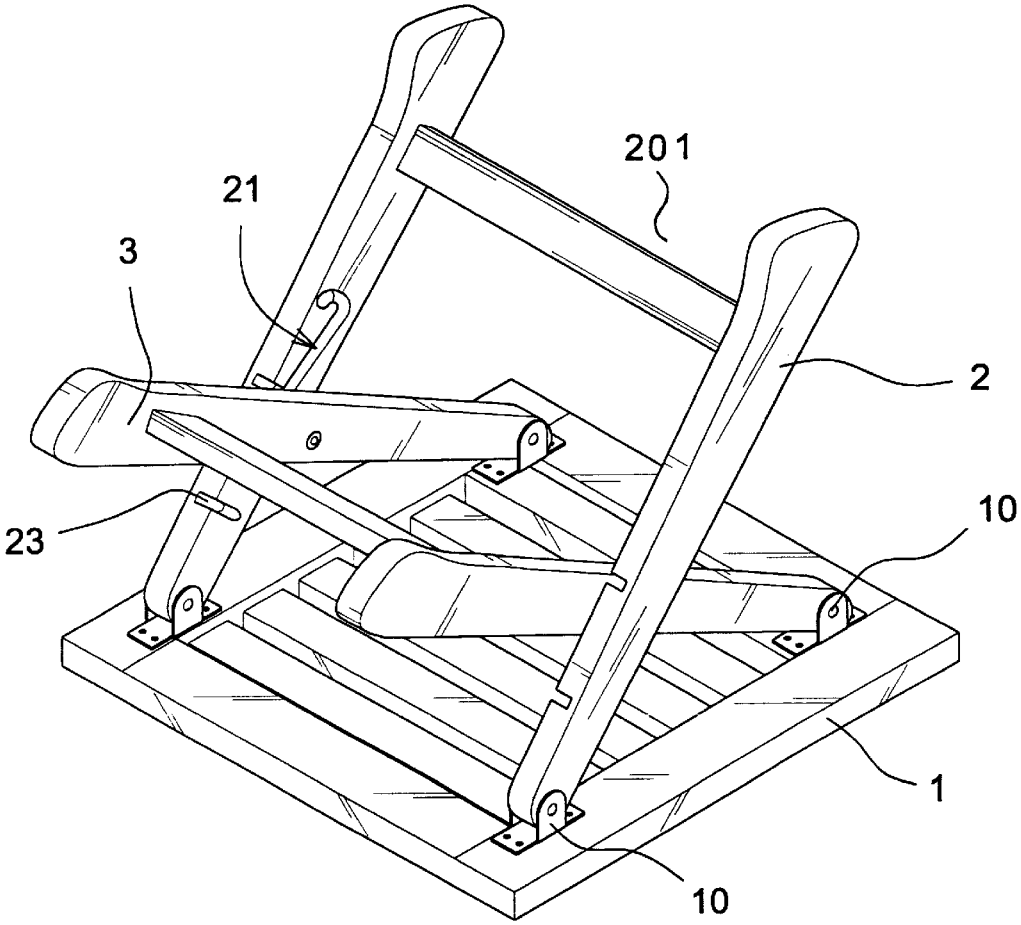
FIG. 4 is a bottom perspective view of the present invention when used as a footrest.

The outer leg frame 200 includes two legs 2 and a cross bar 201 mounted between the two legs 2. Each of the legs 2 is formed with a through hole 20 close to its upper end pivotally connected to a seat 10 fixedly mounted on the bottom of the table top 1 (see FIG. 4). The intermediate portion of the inner side of the leg 2 has a J-shaped positioning groove 21 having an indentation 22. The inner side of the leg 2 is formed with a notch 23 between the through hole 20 and the J-shaped positioning groove 21.

Likewise, the inner leg frame 300 includes two legs 3 and a cross bar 301 mounted between the lower ends of the two legs 3. Each of the legs 3 is formed with a through hole 30 close to its upper end pivotally connected to a seat 10 fixedly mounted on the bottom of the table top 1. The intermediate portion of the inner side of the leg 3 is provided with a protuberance 31 configured to engage with the notch 23.

Figure 3:
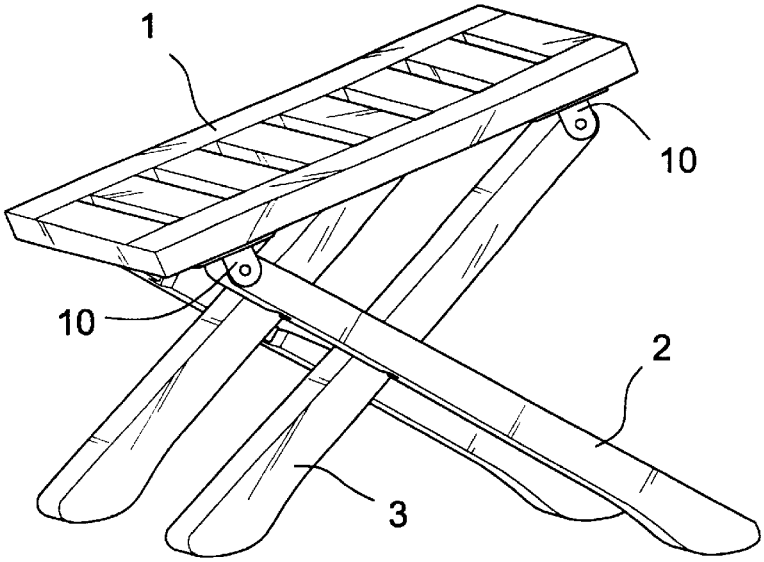
FIG. 3 is a perspective view of the present invention when used as a footrest.
Figure 5:
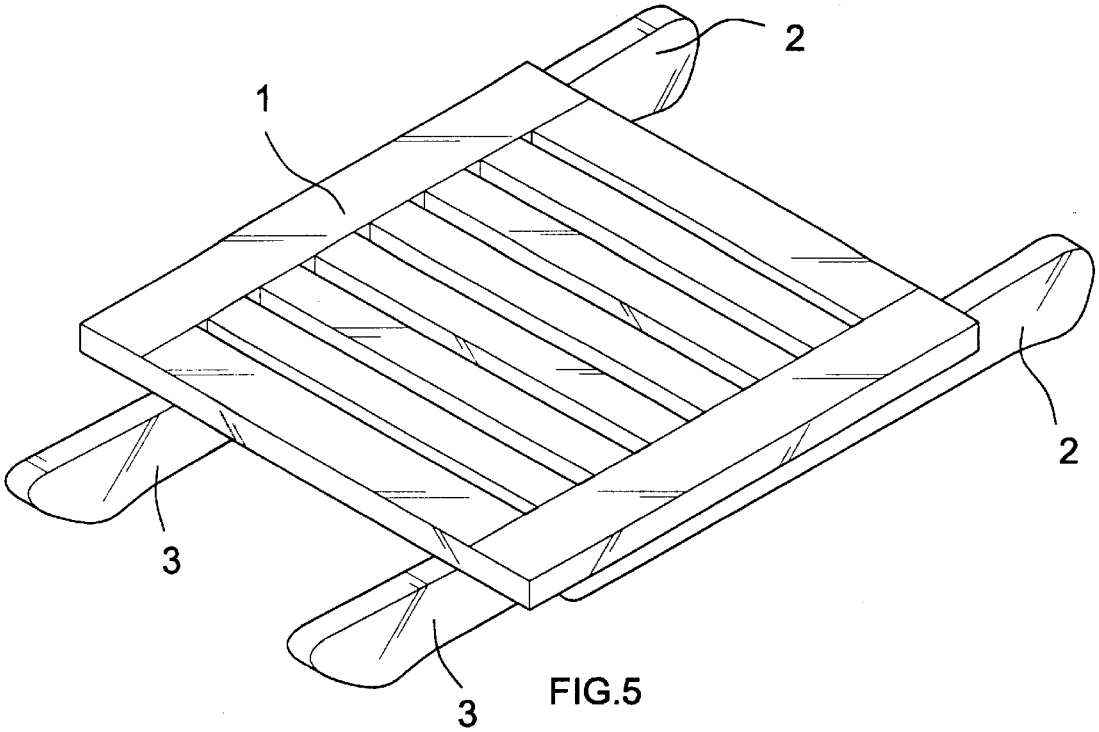
FIG. 5 illustrates the collapsed condition of the present invention.
Figure 6:
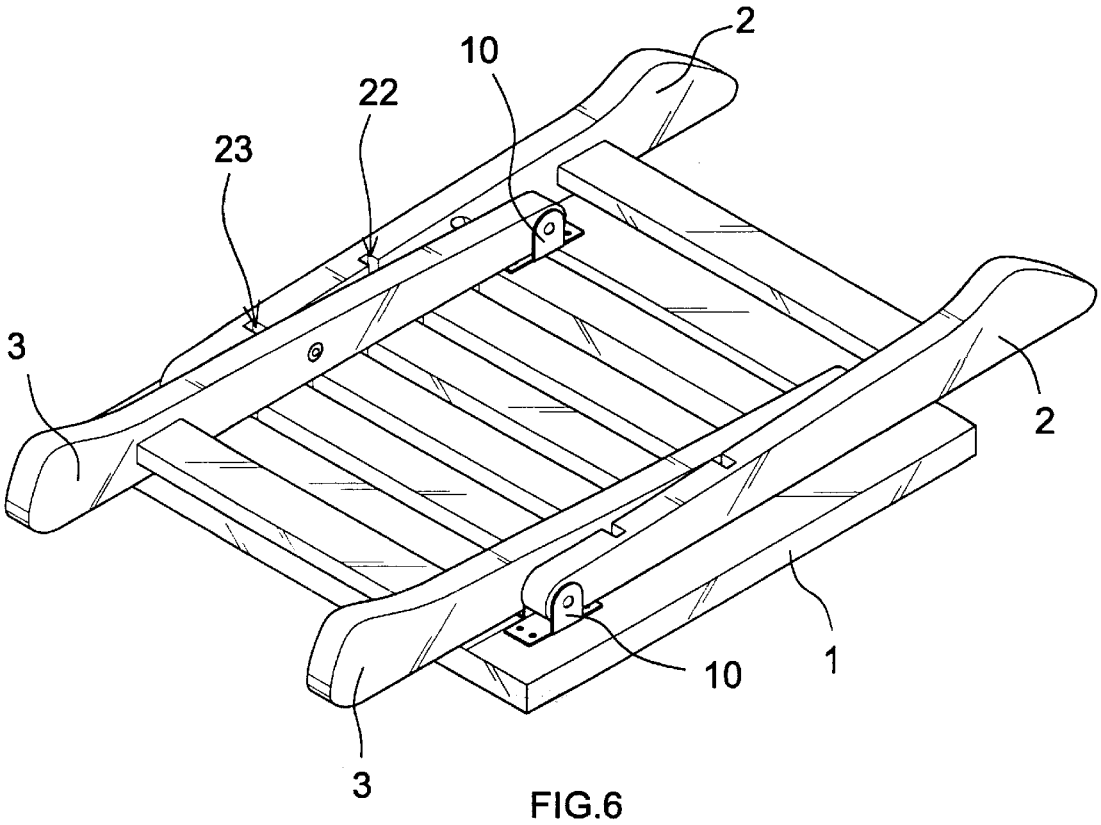
FIG. 6 is a bottom perspective view illustrating the collapsed condition of the present invention.

When the protuberance 31 of the inner leg 3 is fitted into the positioning groove 21 and bears against the upper end (i.e. the hook portion) of the positioning groove 21, the table top 1 will be supported at a horizontal position thereby making the present invention become a teapoy. However, when the protuberance 31 of the inner leg 3 is fitted into the positioning groove 21 and bears against the lower end of the positioning groove 21, the table top 1 will be supported at an inclined position thereby converting the present invention into a foot footrest (see FIGS. 3 and 4). Furthermore, when the protuberance 31 of the inner leg 3 is fitted into the notch 23 of the inner leg 2, the present invention can be folded thereby facilitating the stowage and transportation (see FIGS. 5 and 6).

In conclusion, the present invention utilizes the protuberance 31 of the inner leg to selectively engage with the upper or lower end of the positioning groove 21 of the outer leg 2 to convert the present invention from a teapoy to a foot footrest as desired.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combined teapoy and footrest comprising:

a rectangular table top having a bottom provided with four seats;

an outer leg frame including two first legs and a cross bar mounted between said two first legs, each of said first legs having a through hole close to an upper end thereof pivotally connected with a respective one of said seats, an inner side of each of said first legs having an intermediate portion formed with a J-shaped groove having an indentation, and a notch between said through hole and said J-shaped groove; and an inner leg frame including two second legs and a cross bar mounted between said two second legs, each of said second legs having a through hole close to an upper end thereof pivotally connected with a respective one of said seats, an inner side of each of said second legs having an intermediate portion provided with a protuberance configured to be engageable with said J-shaped groove and said notch.

* * * * *